US009540149B2

(12) United States Patent
Worthington

(10) Patent No.: US 9,540,149 B2
(45) Date of Patent: Jan. 10, 2017

(54) MULTI-CHAMBERED CONTAINER

(71) Applicant: COLGATE-PALMOLIVE COMPANY, New York, NY (US)

(72) Inventor: Brian G. Worthington, Dunellen, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/434,369

(22) PCT Filed: Oct. 19, 2012

(86) PCT No.: PCT/US2012/061058

§ 371 (c)(1),
(2) Date: Apr. 8, 2015

(87) PCT Pub. No.: WO2014/062193

PCT Pub. Date: Apr. 24, 2014

(65) Prior Publication Data

US 2015/0266628 A1 Sep. 24, 2015

(51) Int. Cl.
*B65D 35/22* (2006.01)
*B65D 21/02* (2006.01)
(Continued)

(52) U.S. Cl.
CPC ..... *B65D 35/22* (2013.01); *B65D 1/04* (2013.01); *B65D 1/32* (2013.01); *B65D 21/0201* (2013.01); *B65D 81/3205* (2013.01)

(58) Field of Classification Search
CPC . B65D 35/22; B65D 21/0201; B65D 81/3205; B65D 1/04; B65D 1/32
(Continued)

(56) References Cited

U.S. PATENT DOCUMENTS 1,507,399 A * 9/1924 McCormick ..... B05B 11/041 222/206
2,609,126 A * 9/1952 Buchan ..... B65D 83/06 222/215

(Continued)

FOREIGN PATENT DOCUMENTS

| | | |
|---|---|---|
| DE | 20 2005 002331 | 5/2005 |
| GB | 2 426 751 | 12/2006 |
| RU | 66736 | 9/2007 |

OTHER PUBLICATIONS

International Search Report and the Written Opinion of the International Searching Authority issued in International Patent Application PCT/US2012/061058 mailed May 15, 2013.

(Continued)

*Primary Examiner* — Donnell Long

(57) ABSTRACT

A multi-chambered container for storing and dispensing flowable substances and method for using the same. The container includes a plurality of individual chambers (30, 40,50) each containing a flowable substance. Each chamber (30,40,50) is in fluid communication with a discharge valve assembly. Each chamber includes a pair of structural elements that define an isolated panel. The valve assembly selectively dispenses a single one of the flowable substances in response to one of the isolated panels being pressed or squeezed by a user without simultaneously dispensing the remaining substances.

20 Claims, 5 Drawing Sheets

(51) Int. Cl.
*B65D 1/04* (2006.01)
*B65D 1/32* (2006.01)
*B65D 81/32* (2006.01)

(58) Field of Classification Search
USPC ..... 222/135, 144.5, 145.1, 145.5, 206, 210, 222/211, 215, 212, 213, 420, 422
See application file for complete search history.

(56) References Cited

U.S. PATENT DOCUMENTS 2,770,068 A * 11/1956 Jakab ..... B05B 11/041 222/211
3,011,499 A * 12/1961 Tajan ..... A45D 34/06 132/112
3,325,031 A * 6/1967 Singier ..... A61J 1/05 215/232
3,518,018 A * 6/1970 Woods ..... D06B 11/0056 222/132
3,876,112 A 4/1975 Kramer
4,787,536 A * 11/1988 Widerstrom ..... G01F 11/082 206/532
5,060,453 A * 10/1991 Alberghini ..... B65B 31/00 53/282
5,169,030 A 12/1992 Lewin
5,921,440 A 7/1999 Maines
6,971,551 B2 12/2005 Widgery
7,191,910 B2 * 3/2007 Deemer ..... B65D 1/0223 215/381
2003/0010795 A1 * 1/2003 Duqueroie ..... B65D 1/32 222/212
2011/0101021 A1 * 5/2011 Greer ..... B65D 81/3211 222/1

OTHER PUBLICATIONS

Written Opinion of the International Preliminary Examining Authority issued in International Patent Application PCT/US2012/060776 mailed Oct. 20, 2014.

* cited by examiner

MULTI-CHAMBERED CONTAINER

CROSS-REFERENCE TO RELATED PATENT APPLICATIONS

This application is a U.S. national stage application under 35 U.S.C. §371 of PCT Application No. PCT/US2012/61058, filed Oct. 19, 2012, the entirety of which is incorporated herein by reference.

FIELD OF INVENTION

The present invention relates to containers having multiple compartments or chambers, and more particularly to such containers having structural elements to facilitate dispensing of products contained therein.

BACKGROUND OF THE INVENTION

There are many flowable packaged substances or products on the market today offering many choices to consumers for personal care, oral care, and home care products. Such products may include without limitation body washes, liquid soap, body lotions, shampoos, conditioners, household cleaners, etc. Products within the same category are often available in a variety of formulations, colors, and/or fragrances adding to the type and number of products available. These products may sometimes be packaged together in a single container having multiple compartments. A user may wish to dispense one or more of the products contained in the multiple compartments.

An improved container is desired that provides multiple dispensable products or substances in a single convenient container that includes structural elements to facilitate the dispensing of the desired product(s) and to improve the grippability of the container.

SUMMARY OF INVENTION

A container according to exemplary embodiments of the present invention allows a user to have choice of multiple products in single convenient bottle and dispense only the desired product in lieu of purchasing multiple separate product bottles. In one embodiment, a multi-chamber container for selectively dispensing flowable substances is provided. The container comprises a first chamber for storing a first flowable substance, the first chamber including a first sidewall; a second chamber for storing a second flowable substance, the second chamber including a second sidewall; a first pair of structural elements disposed at an upper portion of the first sidewall and a lower portion of the first sidewall, the upper portion and the lower portion defining a first isolated panel therebetween; a second pair of structural elements disposed at an upper portion of the second sidewall and a lower portion of the second sidewall, the upper portion and the lower portion defining a second isolated panel therebetween; and a discharge valve assembly in fluid communication with the first and second chambers, the valve assembly being configured to dispense the first or second flowable substance.

In another embodiment, a user selectable multi-chamber dispensing system is provided. The dispensing system comprises a first chamber adapted for containing a first flowable substance, the first chamber including a first sidewall and a first pair of structural elements disposed at an upper portion of the first sidewall and a lower portion of the first sidewall, the upper portion and the lower portion defining a first isolated panel therebetween; a second chamber adapted for containing a second flowable substance, the second chamber including a second sidewall and a second pair of structural elements disposed at an upper portion of the second sidewall and a lower portion of the second sidewall, the upper portion and the lower portion defining a second isolated panel therebetween; a third chamber adapted for containing a third flowable substance, the third chamber including a third sidewall and a third pair of structural elements disposed at an upper portion of the third sidewall and a lower portion of the third sidewall, the upper portion and the lower portion defining a third isolated panel therebetween; and a discharge valve assembly in fluid communication with each of the first, second, and third chambers, the dispensing system being configured to dispense a single one of the first, second, or third flowable substances in response to a squeezing force applied to at least one of the first, second, or third isolated panels by user without simultaneously dispensing the other remaining substances.

In yet another embodiment, a method for selectively dispensing a flowable substance from a multi-chambered container is provided. The method comprises providing a container having a first chamber containing a first flowable substance and a second chamber containing a second flowable substance, the first chamber including a first sidewall and a first pair of structural elements disposed at an upper portion of the first sidewall and a lower portion of the first sidewall, the upper portion and the lower portion defining a first isolated panel therebetween, and the second chamber including a second sidewall and a second pair of structural elements disposed at an upper portion of the second sidewall and a lower portion of the second sidewall, the upper portion and the lower portion defining a second isolated panel therebetween; squeezing inward on the first or second isolated panels; and dispensing the first or second flowable substance corresponding to the isolated panel being squeezed without dispensing the substance from the remaining chamber.

In a further embodiment, a multi-chamber container for selectively dispensing flowable substances is provided. The container comprises a first chamber for storing a first flowable substance, the first chamber including a first sidewall; a second chamber for storing a second flowable substance, the second chamber including a second sidewall; a first partition wall disposed between the first chamber and the second chamber; a first structural element disposed on the first sidewall, a first isolated panel defined between the first structural element and the first partition wall; and a discharge valve assembly in fluid communication with the first and second chambers, the valve assembly being configured to dispense the first or second flowable substance.

The multi-chambered container described herein may be used to store and dispense any flowable substance including liquids or fluids of any viscosity so long as the substance is able to flow. Accordingly, the term "flowable substance" shall be construed to mean any product or material capable of flowing including, but not limited to paste, soap, body wash, shampoo, conditioner, lotion, perfume and the like.

The foregoing and other aspects of exemplary embodiments formed according to principles of the present invention are further described herein.

BRIEF DESCRIPTION OF THE DRAWINGS

The features of the preferred embodiments will be described with reference to the following drawings where like elements are labeled similarly, and in which.

Figure 1:
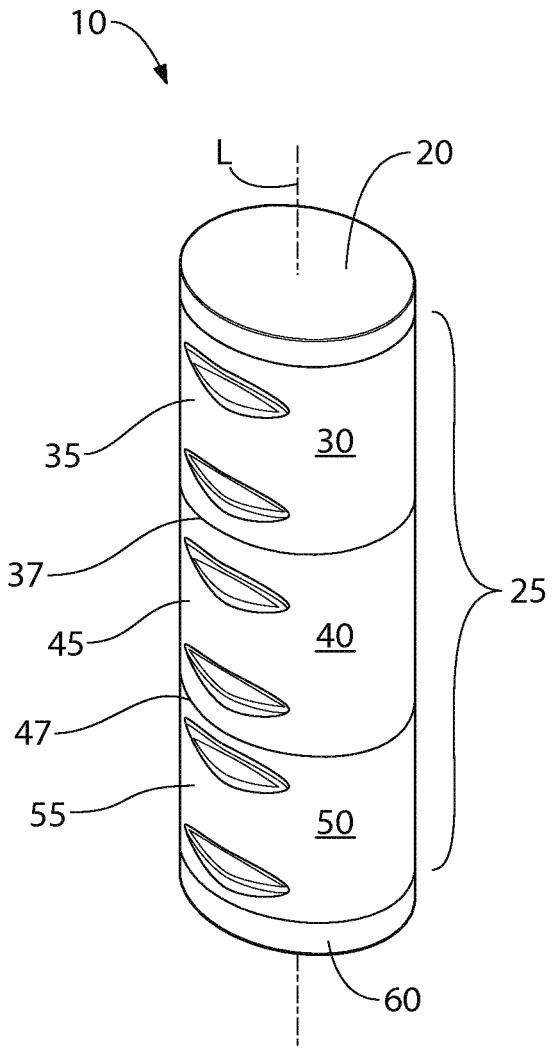
FIG. 1 is a front elevation view of a multi-chambered container closure according to one exemplary embodiment of the present invention.

All drawings are schematic and not actual physical representations of the articles, components or systems described herein, and are further not drawn to scale. The drawings should be interpreted accordingly.

DETAILED DESCRIPTION OF THE INVENTION

This description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
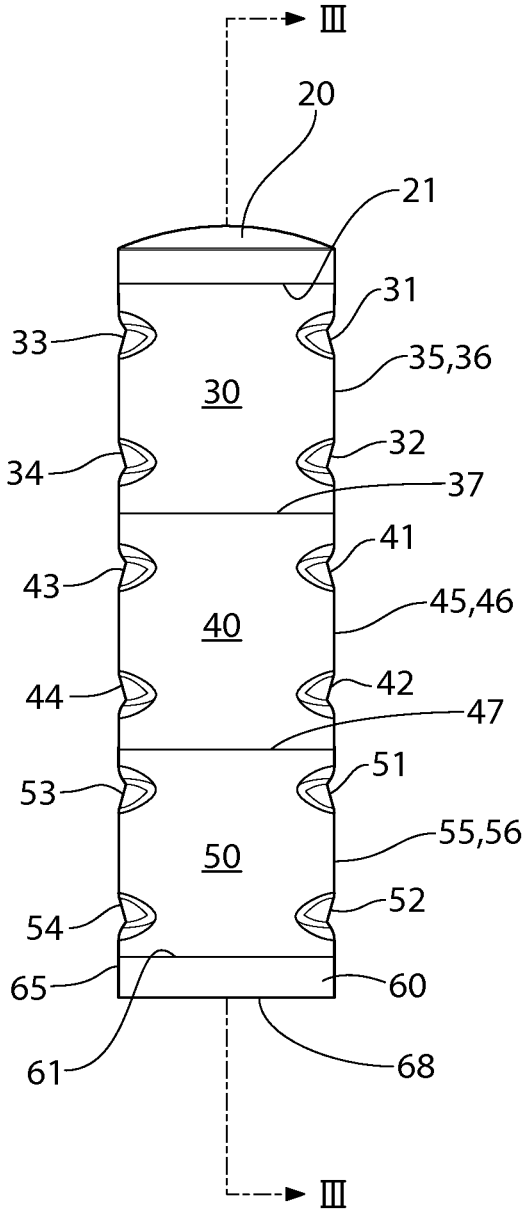
FIG. 2 is a side view of the container of FIG. 1.
Figure 3:
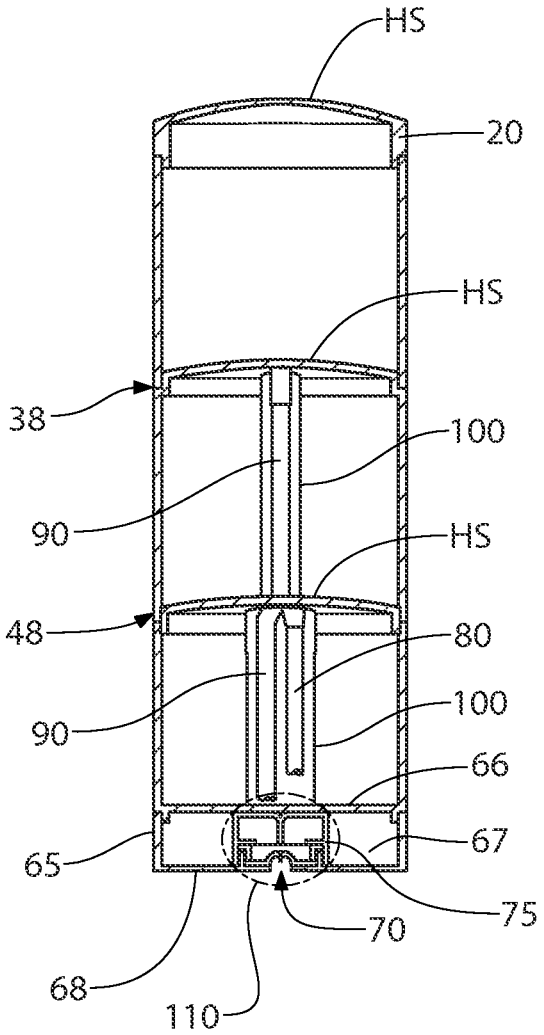
FIG. 3 is a longitudinal frontal cross section taken along line 3-3 in FIG. 2.

FIGS. 1-3 show views of a multi-chambered container 10 according to an exemplary embodiment of the present invention. In the embodiment shown, the container 10 may be formed of several segmented substance-containing chambers which are joined together by suitable conventional means known in the art to form a unitary container. However, other embodiments of the container 10 may be provided in which the chambers are formed as integral parts of the container and not as separate components.

Referring concurrently to FIGS. 1-3, the container 10 includes a top portion 20, a first chamber 30, a second chamber 40, a third chamber 50, a bottom portion 60, and generally vertical container sidewall(s) 25 extending therebetween. In some embodiments, the top portion 20 may include a sealing surface 21 that serve to close and seal an opening to the first chamber 30. Similarly, in those embodiments, the bottom portion 60 may include a sealing surface 61 that serve to close and seal an opening to the third chamber 50. The bottom portion 60, in one embodiment, includes a flat end surface 68 to allow the container 10 to stand upright on a horizontal surface for storage. For example, the container 10 may be placed upright on a shelf for storage. The surface 68 includes an outlet or discharge aperture 70 for dispensing flowable substances from the container 10.

While the container 10 is illustrated with three chambers, the container 10 may have fewer or more chambers as appropriate and/or necessary. In this embodiment where only three chambers are included, the container sidewall 25 is collectively defined by sidewalls 35, 45, 55 of chambers 30, 40, and 50 respectively when the chambers 30, 40, 50 are assembled together. The container sidewall 25 may have any suitable and aesthetically pleasing shape or contour. Correspondingly, the container 10 may have any suitable cross-sectional shape which is collectively formed by the cross-sectional shapes of the sidewall 35, 45, 55 of the chambers 30, 40, 50 including without limitation circular, oval/ellipsoidal, polygonal (e.g. composed of any number and/or orientation of linear segments defining an enclosed space), and combinations thereof. In preferred embodiments, the sidewall 25 has a generally circular or oval/ellipsoidal cross-sectional shape. Accordingly, it will be appreciated by those skilled in the art that the shape of the container 10 need not be uniform in sidewall 25 configuration and may vary in configuration and dimension from top to bottom in various curved or undulating combinations of shapes. For example, in some embodiments, the cross-sectional shapes of each of the chambers 30, 40, 50 may be different from one another.

Each chamber 30, 40, 50 is a generally hollow structure defining a cavity capable of receiving and storing a flowable substance S1, S2, and S3, respectively. Substances S1, S2, and S3 may be similar or different, and in preferred embodiments comprise at least two different substances. With continuing reference to FIGS. 1-3 and particularly FIG. 2, the chamber 30 includes a sidewall 35 having a generally vertical sidewall surface and a plurality of structural elements 31, 32, 33 and 34. In the embodiment as shown, the chamber 30 includes four structural elements, however, it is understood by those skilled in the art that in some embodiments, the chamber 30 may include more or fewer structural elements. Also in the embodiment as shown, the structural elements 31-34 are in the form of a crevice. In some embodiments, the structural elements may be in the form of dimples, recesses, dents or indentations. In the embodiment as shown, the structural element 31 is located on an upper end of the sidewall 35 of the chamber 30 and the structural element 32 is located on a lower end of the side wall 35 of the chamber 30. Also as shown, the structural elements 31 and 32 help to define an isolated panel 36 therebetween. While not shown, it is understood that a similarly constructed isolated panel is defined by the structural elements 33 and 34. In addition, while not shown, in some embodiments, the structural elements may each be in the form of a groove that extends around the circumference of each of the chambers 30, 40, 50.

In the embodiment as shown, the chambers 40 and 50 may be similarly structured and configured to the chamber 30 including, respectively, a plurality of structural elements 41, 42, 43, 44 and a plurality of structural elements 51, 52, 53, 54. In addition, the sidewalls 45 and 55 include, respectively, an isolated panel 46 defined by the structural elements 41 and 42 and an isolated panel 56 defined by the structural elements S1 and S2. The sidewalls 45 and 55 may further include isolated panels formed in between the structural elements 43 and 44 and 53 and 54. In other embodiments, the chambers 30, 40, or 50 may have different shapes and/or dimensions with varying volumetric capacities depending on the overall intended shape of the container 10 and the container sidewall 25 once all chambers 30, 40, 50 are assembled together. In addition, in other embodiments, each of chambers 30, 40, 50 may include different numbers of structural elements, and thus, different number of isolated panels.

The inclusion of the structural elements 31-34, 41-44, 51-54 and the isolated panels 36, 46, 56 on the container 10 proved to be advantageous over existing containers. There are existing water bottles that include slight depression on the sidewall of the bottles. It was noted that when pressing on the depression there was little movement in the container wall and thus lead to little displacement of the water. However, when one pressed below the depression, one was able to achieve more container wall movement and in effect invert a small bubble like section like the "oil can" effect. Indeed, by including a pair of structural elements on an upper section and a lower section of a chamber, an isolated panel could be created that could then be inverted and allow more displacement and to facilitate dispensing from the container 10 as described in the present disclosure.

Still referring back to FIGS. 1-3, the thickness of sidewall 35, 45, and 55 may be uniform or non-uniform along the height and/or circumference of each chamber 30, 40, 50 so long as the overall container 10 is self-supporting when placed on a support surface. Based on the material used for fabricating the chamber sidewalls 35, 45, 55 (to be further described herein) and the material's mechanical properties (i.e. tensile strength, shear strength, modulus of elasticity, etc.), the thickness of the sidewalls is preferably selected so that the chambers 30, 40, 50 may be inwardly and elastically deformed for dispensing flowable substances S1, S2, or S3 when pressed/squeezed by a user, and then return to its original configuration when released. It is well within the ability of those skilled in the art to select appropriate combinations of materials and thicknesses without undue experimentation to achieve the foregoing functionality.

Referring to FIG. 2, the container 10 includes generally horizontal or lateral internal partition walls 37 and 47 which divide the container 10 into a plurality of separate and discrete chambers 30, 40, 50 each capable of holding a flowable substance S1, S2, or S3. The partition walls 37, 47 also laterally stiffen the container sidewall 25 adjacent the walls to resist deformation for reasons which will become apparent as later described herein. The partition walls 37, 47 are coupled to and radially extend from the container sidewall 25 inwards. In the case where the container 10 is formed of conjoined separate chambers 30, 40, 50, as in the exemplary embodiment shown, the partition walls 37 and/or 47 may be molded as a separate component part that is attached between adjacent chambers such as partition wall 37 disposed between the chambers 30 and 40. In other embodiments, the partition walls 37 and/or 47 may be formed and molded as an integral part of one of the chambers such as partition wall 47 of the chamber 40 which separates the chamber 40 from the chamber 50. Accordingly, any combination of these constructions may be used for the partition walls.

Referring to FIGS. 2 and 3, partition walls 37, 47 may be configured to provide headspace HS at the top of each chamber 40, 50. In constructions where the container sidewall 25 is made of a transparent or translucent material, any air trapped in the chambers 30, 40, 50 from the initial substance filling process advantageously will be concealed from the user to provide a more aesthetically pleasing appearance rather than creating a line at the air-substance surface visible from the exterior of the container 10. The partition walls 37, 47 are therefore preferably structured in some embodiments so that a portion of the partition wall defining the headspace HS extends above and vertically up into the bottom of the adjacent chamber, such that the vertically-extended portions of each partition wall are positioned above seams 38, 48 between adjacent vertically stacked chambers. In some embodiments, partition walls 37, 47 may be configured with a domed portion as shown that provides the headspace HS. The headspace HS for the chamber 30 may be provided by vertically-extended portion of the top portion 20 as shown.

It will be appreciated that the term "generally horizontal" used herein to describe exemplary orientations of partition walls 37, 47 contemplates that at least portions of and/or the entirety of these walls may be disposed at various angles to the container sidewall 25 and/or may include a plurality of varying contoured and undulating configurations. This includes allowance for the vertically-extended portions of partition walls 37, 47 that create the headspace HS as noted above. Accordingly, partition walls 37, 47 are expressly not limited to any particular orientation or configuration so long as one chamber 30, 40, 50 may be isolated from the adjoining chamber.

With continuing reference to FIGS. 2 and 3, the bottom portion 60 may include a radially-extending end wall 66. The sealing surface 61, in this embodiment, coincides with a top surface of the end wall 66. In a preferred embodiment, end wall 66 is vertically spaced apart from end surface 68 of the bottom portion 60. When the bottom portion 60 is seated and attached to the container 10, an internal compartment 67 is formed and is bounded by end surface 68, a sidewall 65 of the bottom portion 60 and opposing end wall 66. The internal compartment 67 provides internal space for accommodating portions of a dispensing system for the container 10 as further described herein.

According to another aspect of the invention, a dispensing system is provided that fluidly couples or connects each of the chambers 30, 40, 50 to the discharge aperture 70 of the container 10. Advantageously, the dispensing system is preferably configured to allow a user to selectively dispense substances S1, S2, or S3. A user can select either only one substance of S1, S2, S3 at a time, or more than one substance S1, S2, S3 from their respective chambers. The user selects how many of the substances are to be dispensed. If only one substance is selected, then it is dispensed without being simultaneously mixed with the remaining substances either internal or external to the container 10. If more than one substance is selected by the user, then the selected substances can mix internal or external to the container 10.

The dispensing system will now be described with reference to FIG. 3. The dispensing system includes a plurality of flow conduits 80, 90, 100 which fluidly connect chambers 30, 40, and 50 to a common discharge valve assembly 110 disposed in the bottom portion 60, which in turn is in fluid communication with discharge aperture 70 to dispense the selected substance to the user. Accordingly, common discharge valve assembly 110 is in fluid communication with all three chambers. In a preferred embodiment, discharge valve assembly 110 includes necessary inlet flow manifold(s), and inlet connections or fittings configured for coupling to the flow conduits from each chamber. Preferably, the flow conduits are designed to isolate substances S1, S2, and S3 from each other when dispensed from their respective chamber 30, 40, 50 so the substances do not mix inside the container 10. While the discharge valve assembly 110 is referred to as a common discharge valve assembly, it is understood that in other embodiments, the discharge valve assembly 110 needs not be common to all three chambers 30, 40, 50. Indeed, in some embodiments, separate discharge valve assemblies may be included for dispensing from the separate chambers 30, 40, 50.

In the embodiment as shown, the flow conduit 80 fluidly couples the chamber 40 to the discharge valve assembly 110. In one embodiment, the flow conduit 80 has an upper end connected to an outlet nipple or fitting on the chamber 40 and a lower end connected to discharge valve assembly 110, thereby allowing substance S2 to flow through container 10 while remaining isolated from the other substances. In one possible embodiment, as shown, the flow conduit 80 may be routed internally through the chamber 50. In some other possible embodiments, the flow conduit 80 may be routed external to and bypass the chamber 50. Either arrangement is suitable and a matter of design and aesthetic preference.

The flow conduit 90 fluidly couples the chamber 30 to the discharge valve assembly 110 and conveys flowable substance S1 in a manner similar to flow conduit 80 described above. The flow conduit 90 has an upper end connected to an outlet fitting on the chamber 30 and a lower end connected to the discharge valve assembly 110. Flow conduit 100 similarly conveys flowable substance S3 and has an upper end connected to an outlet fitting on the chamber 50 and a lower end connected to the discharge valve assembly 110.

Similar to flow conduit 80 described above, flow conduits 90 and 100 may be routed internally through the chambers 40 and/or 50 of the container 10 in some embodiments, and in other possible embodiments flow conduits 90, 100 may be routed external to and bypass chambers 40 and/or 50 as a matter of design and aesthetic preference. Accordingly, it will be appreciated that in some embodiments one or more of flow conduits 80, 90, 100 may be located on the exterior of the container 10. The invention is therefore not limited by the placement of the flow conduits 80, 90, 100 on either the exterior or in the interior of the container 10 so long as the flow conduits may be coupled to the discharge valve assembly 110.

The flow conduits of the dispensing system in some embodiments may comprise both soft flexible and/or relatively rigid plastic tubular conduits and relatively rigid flow fittings including combinations of all of the foregoing types of tubular conduits and fittings. In one possible embodiment, for example without limitation, flow conduits 80, 90, and 100 may be made of a suitable flexible plastic tubing which can be readily shaped and curved in a routing path between their respective chambers. The flow fittings are preferably made of a suitable plastic harder and more rigid than the tubing in a conventional manner for securing the tubing thereto. Additional intermediate fittings (i.e. fittings other than those that may also be used at the termination points of the flow conduits) may also be used. These may include, for example, 30, 45, or 90 degree tubing elbows or straight tubing connectors as commonly used in tubing systems to allow efficient routing of the flow conduits in the container 10. In some other possible embodiments, the flow conduits 80, 90, and 100 may be formed of a rigid plastic tube that may be integrally molded as part of a chambers 30, 40, 50 or as a separate component.

The coupling between tubing and/or fitting connections may be made by any suitable technique commonly used in the art such as without limitation mechanical couplings (e.g. friction fit, threaded, etc.), ultrasonic welding, adhesives, etc. so long a relatively leak resistant joint is formed.

In one embodiment, the discharge valve assembly 110 may be disposed in the internal compartment 67 and supported by the bottom portion 60. The discharge valve assembly 110 preferably communicates with the discharge aperture 70 for dispensing user-selected substances S1, S2, or S3 and may be positioned in any suitable location with internal compartment 67 of the bottom portion 60. The discharge valve assembly 110 may include an inlet flow manifold, an elastomeric valve, and flexible flaps capable of resiliently opening to dispense one of the substances S1, S2, or S3 therethrough, and then returning to a closed position for stopping flow and reducing suckback (i.e. uptake of air back into the container when the user-applied inward pressing or squeezing force is removed from the container). In some embodiments, the discharge valve assembly 110 may also include an internal flow mixing reservoir that allows two or more flowable substances S1, S2, and S3 to be simultaneously blended or mixed together prior to dispensing through the discharge aperture 70.

In one embodiment, the discharge valve assembly 110 may include an inlet flow manifold 75 that may be concentrically aligned with discharge aperture 70. In preferred embodiments, the discharge valve assembly 110 and discharge aperture 70 are both concentrically and axially aligned with a longitudinal axis L of the container 10 as shown. In other possible embodiments, the discharge valve assembly 110 and the discharge aperture 70 may be positioned off axis with respect to the longitudinal axis L of the container 10 depending on the intended design. In addition, in some embodiment, the discharge valve assembly 110 may include a discharge valve, or a check valve, where the inlet flow manifold 75 and the discharge valve are closely coupled to minimize the length of the flow path therebetween which might otherwise allow for an excessive amount of residual substance or product to accumulate. However, it is possible to separate the inlet flow manifold 75 from the discharge valve by some distance to accommodate the configuration of the container to be provided.

As discussed above, the discharge valve assembly 110 may include the inlet flow manifold 75, inlet connection(s) or fitting(s), and valve(s) necessary to allow the substances S1, S2, S3 to flow from the chambers 30, 40, 50. However, these various components are not illustrated or discussed in details as the invention is not limited to any particular placement or configuration of the flow conduits and or the internal components so long as the flow conduits may fluidly connect the chambers 30, 40, 50 to the discharge valve assembly 110.

A multi-chambered container 10 according to the present invention is preferably formed of a material that is at least partially flexible/resilient with a shape memory so as to be non-permanently and elastically deformable by a user when applying an inward pressing or squeezing force F to dispense the contents of one of the chambers 30, 40, 50. Preferably, the material will then allow the squeezed container to return to its original shape when the force is removed. In some embodiments, preferably, the container 10 may be made of any suitable conventional thermoplastic material commonly used in the art so long as the material has the mechanical properties that allow it to deform temporarily when squeezed by a user, and then return to its original undeformed shape. Some exemplary embodiments of suitable thermoplastics that may be used include, without limitation, polypropylenes (PP), polyethylenes (PE), polyethylene terephthalate (PET/PETE), thermoplastic elastomers, etc. In some preferred embodiments, the material selected for the multi-chambered container has properties of being transparent or translucent to allow the product and its color stored inside to be seen by the user.

Multi-chambered container 10 may be constructed in various suitable manners. In some possible embodiments, chambers 30, 40, 50 of the multi-chambered container may each be individually molded separately and then joined together by any suitable means commonly used in the art to form a unitary container such as without limitation ultrasonic welding, adhesives, mechanical coupling such as snap locking, shrink or press fitting, etc. Alternatively, in other possible embodiments, chambers 30, 40, 50 may be molded and formed as integral parts of a single larger container 10 fabricated together in one or more steps. Accordingly, the present invention contemplates at least both foregoing possible types of the fabrication techniques for the container 10 and chambers 30, 40, 50, and is not limited to either. In either of the foregoing fabrication scenarios, the multi-chambered container 10 and chambers 30, 40, 50 may be formed by any conventional suitable means used in the art such as blow molding, injection molding, or vacuum forming as some non-limiting examples.

Operation of the multi-chambered container 10 according to embodiments of the present invention will now be described. Preferably, dispensing of flowable substances S1, S2, and/or S3 from container 10 is actuated by applying an inward squeezing or pressing force on one or more of chambers 30, 40, 50 as described below, such as by applying a force on one of the isolated panels 36, 46 or 56. A user may choose to dispense a single substance or multiple substances from the container 10. To dispense one of the flowable substances S1, S2, or S3 from container 10, a user first selects which substance is desired to be dispensed. The user then applies an inward squeezing or pressing force F on the isolated panels of the chambers 30, 40, or 50 corresponding to the selected substance. For example, the user may apply a force F on the isolated panel 36 to dispense substance S1 from the chamber 30. The inward pressing force F is preferably applied in a direction toward the longitudinal axis L of the container 10 (or axial centerline of the container 10), but need not necessarily be applied precisely in that direction to dispense the selected substance. It is understood that actuation of the container 10 to dispense flowable substances S1, S2, and/or S3 may be accomplished by the application of numerous different squeezing or pressing forces F on the container sidewalls 25 so long as one or more of chambers 30, 40, 50 are pressurized. For example, in one embodiment, the chambers 30 may include the structural elements 31, 32, 33, and 34. The structural elements 31 and 32 define an isolated panel 36 therebetween. Similarly, the structural elements 33 and 34 may define an isolated panel (not shown by reference number) therebetween. To dispense substance S1 from the chamber 30, a user may apply forces to both isolated panels, such as by squeezing the chamber 30 between the user's thumb and finger.

It will be appreciated that in some operating methods or modes of using multi-chambered container 10, a user may select more than one flowable substances S1, S2, S3 for dispensing simultaneously by applying an inward pressing force F on more than one isolated panels 36, 46, 56 at the same time. For example, a user may simultaneously apply a force F on isolated panels 36 and 46, 36 and 56, 46 and 56, or 36, 46, and 56 to simultaneously dispense multiple substances S1, S2, and S3. In some embodiments of containers having more or less than three chambers 30, 40, 50 as shown herein, the same foregoing dispensing methodology may be applied to selectively dispense multiple substances S1, S2, and S3. Accordingly, exemplary methods of using container 10 according to present invention advantageously enable a user to create custom mixes or blends of substances S1, S2, and S3. For example, without limitation, if flowable substances S1, S2, and S3 are body washes, S1 may contain a skin exfoliating formulation, S2 may contain a vitamin enriched skin-nourishing formulation, and S3 may contain a moisturizing formula. Depending on the user's particular needs or preferences at a given bathing or washing time, a single one of these S1, S2, or S3 formulations may be dispensed or custom blends of any two or more of these formulations may be simultaneously dispensed together and blended thereby advantageously combining the benefits and properties of each respective formulation selected. Accordingly, this latter multiple substance custom blending and dispensing operating mode is advantageously provided by multi-chambered container 10 according to the present invention.

When an inward force F is applied by a user, the isolated panels 36, 46, 56 (and thus, the flexible sidewalls 35, 45, 55) corresponding to the user-selected chamber 30, 40, or 50 (respectively) will deform elastically inwards and be pressured by the reduction in volumetric capacity. Substance S1, S2, or S3 corresponding to the selected chamber will therefore be selectively discharged and flow into its respective flow conduit 80, 90, or 100 without simultaneously dispensing the remaining non-selected substances. The lateral partition walls 37 and 47, which separate the chambers 30, 40, 50, laterally brace and radial stiffen the container which helps to resist the pressing force F and deformation of the adjacent non-selected chamber sidewalls 35, 45, and/or 55 to preferably eliminate (or at least minimize) simultaneous dispensing of non-selected substances. The selected substance S1, S2, or S3 will flow downwards through the container in its respective flow conduit 80, 90, 100 (bypassing the non-selected chambers) and into the discharge valve assembly 110.

When the user stops pressing or squeezing on the selected chamber (i.e. removes inward force F), the inwardly and temporarily deformed chamber sidewall 35, 45, or 55 (depending on the chamber 30, 40, or 50 selected) will elastically return to its original shape or position which lowers the pressure in the chamber back to its initial pre-deformation state.

According to other embodiments of the present multi-chambered container 10, it will be appreciated that flowable substances S1, S2, and S3 need not be dispensed or discharged from each chamber 30, 40, 50 at the bottom portion 60 of the container 10, in a common direction, or from a common end or single location alone as shown and described herein in some embodiments. For example, in other possible embodiments, a valve assembly similar to without limitation the discharge valve assembly 110, or of other suitable similar design, may instead be located at the top portion 20 of the container 10 using a dispensing system including flow conduits such as without limitation those similar to 80, 90, and 100 described herein. According to yet other possible embodiments, at least some of the chambers 30, 40, 50 may dispense their respective flowable substances S1, S2, or S3 from different locations and/or in different directions from each other. Such embodiments may include separate discharge apertures 70 each with an associated discharge valve disposed at different locations on container 10 and chambers 30, 40, 50. It is readily within the ability of those skilled in the art to reverse the location of the discharge valve assemblies to top portion 20, or to locate one or more discharge valve assemblies on the container 10 based on the description and principles already provided herein without additional discussion.

Figure 4:
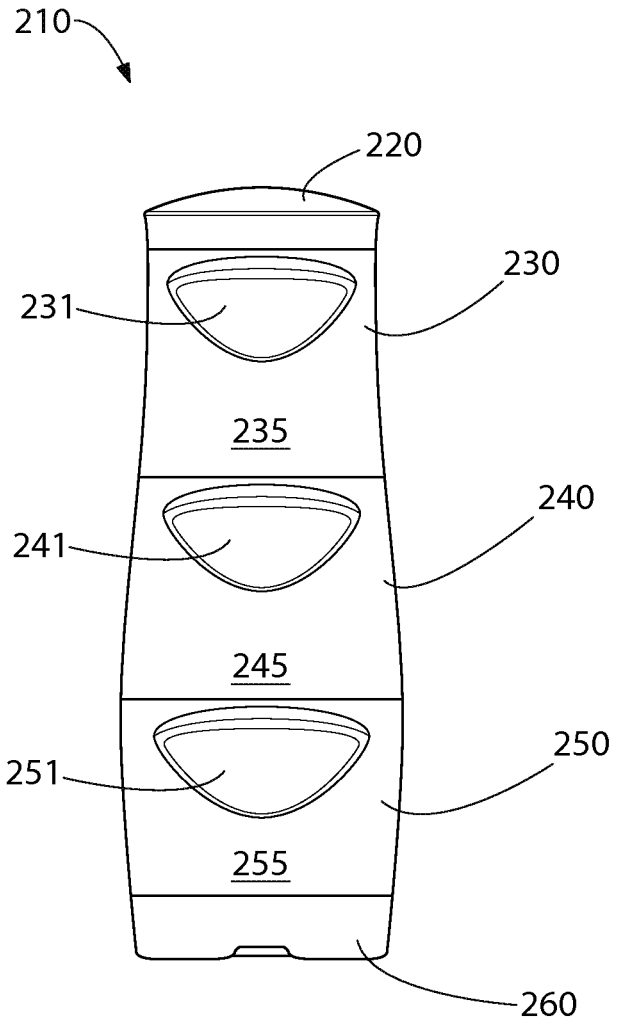
FIG. 4 is a front view of a multi-chambered container closure according to another exemplary embodiment of the present invention.
Figure 5:
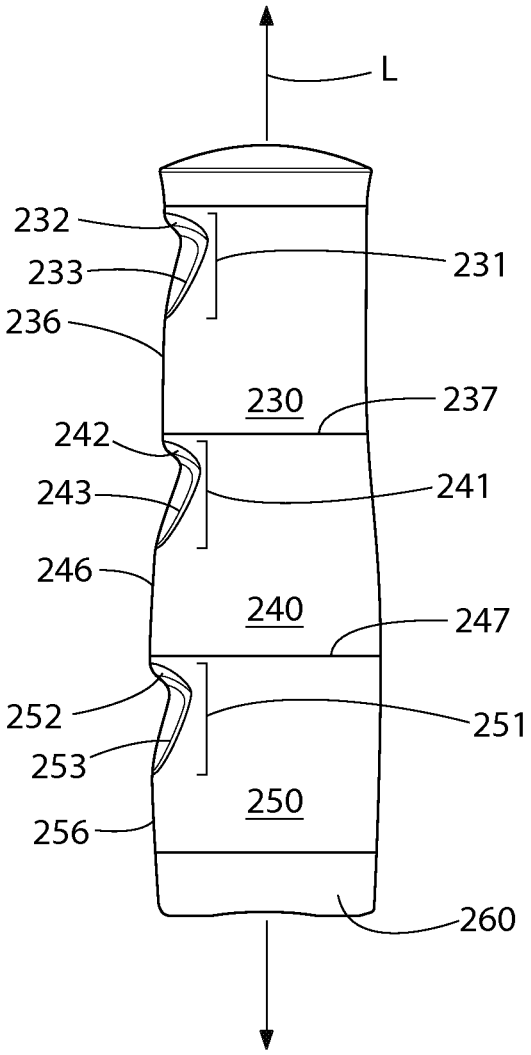
FIG. 5 is a side view of the container of FIG. 4.

FIGS. 4 and 5 show views of a multi-chambered container 210 according to an exemplary embodiment of the present invention. As shown, the multi-chambered container 210 has a similar construction as the multi-chamber container 10 shown in FIGS. 1-3. The container 210 includes a top portion 220, a first chamber 230, a second chamber 240, a third chamber 250, a bottom portion 260, and generally vertical container sidewall(s) 225 extending therebetween. While the container 210 is illustrated with three chambers, the container 210 may have fewer or more chambers as appropriate and/or necessary. In this embodiment where only three chambers are included, the container sidewall 225 is collectively defined by sidewalls 235, 245, 255 of chambers 230, 240, and 250 respectively when the chambers 230, 240, 250 are assembled together. As shown, the shape of the container 210 need is not uniform in sidewall 225 configuration due to the variation in the cross-sectional shapes of each of the chambers 230, 240, 250.

With continuing reference to FIGS. 4 and 5, the chamber 230 includes a structural element 231 on the sidewall 235. The structural element 231 includes an upper portion 232 and a lower portion 233. As shown, the upper portion 232 extends radially inward towards a longitudinal axis L of the container 210, while the lower portion 233 extends downwardly along the sidewall 235. Together, the upper portion 232 and the lower portion 233 form a crevice that may be in the shape of a half-shell. In other embodiments, the structural element 231 may be a dimple, a recess, a dent or an indentation. Also as shown, an isolated panel 236 is formed between the lower portion 233 and a lateral partition wall 237 disposed between the chambers 230 and 240. In the embodiment as shown, the chambers 240 and 250 may be similarly structured and configured to the chamber 230 including, respectively, a structural element 241 and 251. In addition, the sidewalls 245 and 255 may include, respectively, an isolated panel 246 defined by the structural element 241 and a partition wall 247, and an isolated panel 256 defined by the structural element 251 and a sealing surface 261 of the bottom portion 260.

The inclusion of the structural elements 231, 241 and 251 and the isolated panels 236, 246, 256 on the container 210 proved to be advantageous over existing containers. Specifically, in the container 210 as shown, it is noted that each of the chambers 230-250 has relatively short sidewalls compared to existing water bottles that include slight depression on the sidewall of the bottles. In addition, the inclusion of the partition walls 237 and 247 and the sealing surface 261 provides a stiffening effect to the overall structure of the chambers 230-250. In order to overcome the relative shorter sidewalls and the stiffened chambers and generate greater movement in a limited volume, it was noted that the moment arm associated with each chamber must be increased. For example, it was noted that the inclusion of the structural element 231 resulted in an increase in the moment arm, because the inclusion of the structural element 231 in effect introduces a small bubble like section, i.e., the isolated chamber 236, like the "oil can" effect.

While not shown in detail, the container 210 may include a similar discharge valve assembly similar to the discharge valve assembly 110 of the container 10. For example, the container 210 may include a discharge valve assembly that includes a discharge aperture 270 to dispense the selected substance to the user, necessary inlet flow manifold(s), and inlet connections or fittings configured for coupling to the flow conduits from each chamber 230, 240, 250. The operation of the container 210 may be similar or identical to the operation of the container 10, and thus is not discussed in detail.

Based on the foregoing, it will be readily apparent that numerous variations in dispensing/discharge configurations may be provided according to principles of the present invention so long as a single flowable substance S1, S2, or S3 may be selectively dispensed by a user at the exclusion of the remaining substances.

It will be appreciated by those skilled in the art that although the dispensing method may have been described herein for convenience assuming the container 10 or the container 210 is preferably held in a generally vertical orientation, it is possible to dispense substances S1, S2, or S3 with the container held in any suitable position including horizontally if desired. The substances, however, will be most effectively dispensed if the user holds the container 10 (or the container 210) anywhere from horizontal to vertical, and any position therebetween. Accordingly, the invention is not limited to any particular orientation of the multi-chambered container when the user dispenses the substance or product.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A multi-chamber container for selectively dispensing flowable substances, comprising:

a first chamber for storing a first flowable substance, the first chamber including a first sidewall;

a second chamber for storing a second flowable substance, the second chamber including a second sidewall;

a first pair of structural elements disposed at an upper portion of the first sidewall and a lower portion of the first sidewall, the upper portion and the lower portion defining a first isolated panel therebetween;

a second pair of structural elements disposed at an upper portion of the second sidewall and a lower portion of the second sidewall, the upper portion and the lower portion defining a second isolated panel therebetween; and a discharge valve assembly in fluid communication with the first and second chambers, the valve assembly being configured to dispense the first or second flowable substance;

wherein the structural elements comprise crevices, dimples, recesses, dents or indentations;

wherein the first and second isolated panels define bubble-like sections of the first and second sidewall, respectively, and the first and second isolated panels are configured to deform elastically inwards to reduce a volumetric capacity of the first or second chambers, respectively, when a force is applied to the first and second isolated panels to respectively dispense the first and second flowable substances.

2. The container of claim 1, wherein the second chamber is disposed vertically on top of the first chamber.

3. The container of claim 1, further comprising:

a third chamber for storing a third flowable substance, the third chamber including a third sidewall, the third chamber being in fluid communication with the discharge valve assembly, wherein the valve assembly is further configured to dispense the first, second, or third flowable substance.

4. The container of claim 3, wherein the third chamber further comprising a third pair of structural elements disposed at an upper portion of the third sidewall and a lower portion of the third sidewall, the upper portion and the lower portion defining a third isolated panel therebetween.

5. The container of claim 3, wherein:

the first chamber further comprises a fourth pair of structural elements disposed at an upper portion of a fourth sidewall, the fourth sidewall opposing the first sidewall, and a lower portion of the fourth sidewall, the upper portion and the lower portion defining a fourth isolated panel therebetween;

the second chamber further comprises a fifth pair of structural elements disposed at an upper portion of a fifth sidewall, the fifth sidewall opposing the second sidewall, and a lower portion of the fifth sidewall, the upper portion and the lower portion defining a fifth isolated panel therebetween; and the third chamber further comprises a sixth pair of structural elements disposed at an upper portion of a sixth sidewall, the sixth sidewall opposing the third sidewall, and a lower portion of the sixth sidewall, the upper portion and the lower portion defining a sixth isolated panel therebetween.

6. The container of claim 1, wherein the discharge valve assembly is operable to simultaneously dispense both the first and second flowable substances.

7. The container of claim 1, wherein the second chamber is disposed laterally adjacent to the first chamber.

8. A user selectable multi-chamber dispensing system comprising:

a first chamber adapted for containing a first flowable substance, the first chamber including a first sidewall and a first pair of structural elements disposed at an upper portion of the first sidewall and a lower portion of the first sidewall, the upper portion and the lower portion defining a first isolated panel therebetween;

a second chamber adapted for containing a second flowable substance, the second chamber including a second sidewall and a second pair of structural elements disposed at an upper portion of the second sidewall and a lower portion of the second sidewall, the upper portion and the lower portion defining a second isolated panel therebetween;

a third chamber adapted for containing a third flowable substance, the third chamber including a third sidewall and a third pair of structural elements disposed at an upper portion of the third sidewall and a lower portion of the third sidewall, the upper portion and the lower portion defining a third isolated panel therebetween; and a discharge valve assembly in fluid communication with each of the first, second, and third chambers, the dispensing system being configured to dispense a single one of the first, second, or third flowable substances in response to a squeezing force applied to at least one of the first, second, or third isolated panels by user without simultaneously dispensing the other remaining substances;

wherein the structural elements comprise crevices, dimples, recesses, dents or indentations;

wherein the first, second, and third isolated panels define bubble-like sections of the first, second, and third sidewall, respectively, and the first, second, and third isolated panels are configured to deform elastically inwards to reduce a volumetric capacity of the first, second, or third chambers, respectively, when a force is applied to the first, second, or third isolated panels to respectively dispense the first, second and third flowable substances.

9. The dispensing system of claim 8, wherein:

the first chamber further comprises a fourth pair of structural elements disposed at an upper portion of a fourth sidewall, the fourth sidewall opposing the first sidewall, and a lower portion of the fourth sidewall, the upper portion and the lower portion defining a fourth isolated panel therebetween;

the second chamber further comprises a fifth pair of structural elements disposed at an upper portion of a fifth sidewall, the fifth sidewall opposing the second sidewall, and a lower portion of the fifth sidewall, the upper portion and the lower portion defining a fifth isolated panel therebetween; and the third chamber further comprises a sixth pair of structural elements disposed at an upper portion of a sixth sidewall, the sixth sidewall opposing the third sidewall, and a lower portion of the sixth sidewall, the upper portion and the lower portion defining a sixth isolated panel therebetween.

10. The dispensing system of claim 9, wherein the discharge valve assembly is operable to simultaneously dispense two or more of the first, second, and third flowable substances.

11. The dispensing system of claim 10, wherein the second chamber is disposed between the first and third chambers, and the discharge valve assembly is further operable to simultaneously dispense and blend the first and third flowable substances from their respective chambers without simultaneously dispensing the second flowable substance from the second chamber.

12. A method for selectively dispensing a flowable substance from a multi-chambered container, comprising:

providing a container having a first chamber containing a first flowable substance and a second chamber containing a second flowable substance, the first chamber including a first sidewall and a first pair of structural elements disposed at an upper portion of the first sidewall and a lower portion of the first sidewall, the upper portion and the lower portion defining a first isolated panel therebetween, and the second chamber including a second sidewall and a second pair of structural elements disposed at an upper portion of the second sidewall and a lower portion of the second sidewall, the upper portion and the lower portion defining a second isolated panel therebetween;

squeezing inward on the first or second isolated panels; and dispensing the first or second flowable substance corresponding to the isolated panel being squeezed without dispensing the substance from the remaining chamber;

wherein the structural elements comprise crevices, dimples, recesses, dents or indentations, and wherein the first and second isolated panels define bubble-like sections of the first and second sidewall, respectively, and the first and second isolated panels are configured to deform elastically inwards to reduce a volumetric capacity of the first and second chambers, respectively, when squeezed inwards.

13. The method of claim 12, further comprising squeezing inward on both the first and second isolated panels and dispensing both the first and second flowable substances essentially simultaneously.

14. The method of claim 12, further comprising providing a third chamber containing a third flowable substance, the third chamber being connected to the second chamber, the third chamber including a third sidewall and a third pair of structural elements disposed at an upper portion of the third sidewall and a lower portion of the third sidewall, the upper portion and the lower portion defining a third isolated panel therebetween, wherein the third isolated panel defines a bubble-like section of the third sidewall, and the third isolated panel is configured to deform elastically inwards to reduce a volumetric capacity of the third chamber when squeezed inwards.

15. The method of claim 14, further comprising squeezing inward on the first, second and third isolated panels and dispensing the first, second and third flowable substances essentially simultaneously.

16. The method of claim 14, further comprising squeezing inward on the first and third isolated panels and dispensing the first and third flowable substances essentially simultaneously without dispensing the second flowable substance.

17. The method of claim 14, further comprising:

providing a fourth pair of structural elements at an upper portion of a fourth sidewall of the first chamber, the fourth sidewall opposing the first sidewall, and a lower portion of the fourth sidewall, the upper portion and the lower portion defining a fourth isolated panel therebetween;

providing a fifth pair of structural elements at an upper portion of a fifth sidewall of the second chamber, the fifth sidewall opposing the second sidewall, and a lower portion of the fifth sidewall, the upper portion and the lower portion defining a fifth isolated panel therebetween; and providing a sixth pair of structural elements at an upper portion of a sixth sidewall of the third chamber, the sixth sidewall opposing the third sidewall, and a lower portion of the sixth sidewall, the upper portion and the lower portion defining a sixth isolated panel therebetween.

18. A multi-chamber container for selectively dispensing flowable substances, comprising:

a first chamber for storing a first flowable substance, the first chamber including a first sidewall;

a second chamber for storing a second flowable substance, the second chamber including a second sidewall;

a first partition wall disposed between the first chamber and the second chamber;

a first structural element disposed on the first sidewall, a first isolated panel defined between the first structural element and the first partition wall; and a discharge valve assembly in fluid communication with the first and second chambers, the valve assembly being configured to dispense the first or second flowable substance;

wherein the structural elements comprise crevices, dimples, recesses, dents or indentations;

wherein the first isolated panel is arranged to be squeezed inwardly to dispense the first flowable substance, wherein the first isolated panel defines a bubble-like section of the first sidewall, and the first isolated panel is configured to deform elastically inwards to reduce a volumetric capacity of the first chamber when squeezed inwards.

19. The container of claim 18, further comprising:

a third chamber for storing a third flowable substance, the third chamber including a third sidewall, the third chamber being in fluid communication with the discharge valve assembly, wherein the valve assembly is further configured to dispense the first, second, or third flowable substance.

20. The container of claim 19, further comprising a second partition wall disposed between the second chamber and the third chamber;

a second structural element disposed on the second sidewall, a second isolated panel defined between the second structural element and the second partition wall; and wherein the third chamber further comprising a third structural element disposed on the third sidewall, a third isolated panel defined between the third structural element and a sealing surface that seals the third chamber.

* * * * *